US006654964B1

(12) United States Patent
Staihar et al.

(10) Patent No.: US 6,654,964 B1
(45) Date of Patent: Dec. 2, 2003

(54) SOCCER GOALKEEPER'S GLOVE

(75) Inventors: Steven Staihar, Hillsboro, OR (US); Richard Avis, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/893,358

(22) Filed: Jun. 26, 2001

(51) Int. Cl.[7] ..... A41D 19/00
(52) U.S. Cl. ..... 2/161.1; 2/169
(58) Field of Search ..... 2/161.1, 159, 161.2, 2/161.4, 161.6, 163, 167, 169, 16, 20

(56) References Cited

U.S. PATENT DOCUMENTS

| | | | | |
|---|---|---|---|---|
| 144,665 A | | 11/1873 | Foster | |
| 567,749 A | | 9/1896 | Morgan | |
| 666,853 A | | 1/1901 | Morgan | |
| 692,224 A | | 2/1902 | Baird | |
| 1,252,900 A | | 1/1918 | Grinnell | |
| 1,377,338 A | | 5/1921 | Grinnell | |
| 2,464,378 A | * | 3/1949 | Coupas et al. | 2/169 |
| 2,552,258 A | * | 5/1951 | Collins | 2/169 |
| 3,760,425 A | | 9/1973 | Komatsu | |
| 3,961,377 A | | 6/1976 | Lars-Jos | |
| 5,136,725 A | | 8/1992 | Montero | |
| 5,515,548 A | | 5/1996 | Lazarus | |
| 5,682,614 A | | 11/1997 | Lazarus | |
| 5,720,047 A | | 2/1998 | Spitzer | |
| 5,774,896 A | | 7/1998 | Hochmuth | |
| 5,790,985 A | | 8/1998 | Hocnmuth | |
| 5,809,571 A | | 9/1998 | Spitzer | |
| 5,850,635 A | | 12/1998 | Lazarus | |
| 5,867,830 A | | 2/1999 | Chen | |
| 5,881,385 A | | 3/1999 | Hochmuth | |
| 5,937,444 A | | 8/1999 | Hochmuth | |
| 6,006,359 A | | 12/1999 | Lazarus | |
| 6,115,842 A | | 9/2000 | Hochmuth | |
| 6,125,473 A | | 10/2000 | Hochmuth | |

FOREIGN PATENT DOCUMENTS

| | | |
|---|---|---|
| CH | 518 690 | 2/1972 |
| DE | 9318227 | 3/1994 |
| EP | 336 204 | 10/1989 |

OTHER PUBLICATIONS

TSI Soccer Catalog, Nov. 2000.
PUMA Team Soccer Catalog, 2000/2001.
UMBRO 1998 Fall/Winter Catalog.
UHLSport 1999 Catalog.

* cited by examiner

*Primary Examiner*—Gary L. Welch
(74) *Attorney, Agent, or Firm*—Banner & Witcoff, Ltd.

(57) ABSTRACT

A goalkeeper's glove is disclosed, wherein use of a specialized pattern for the element comprising the palmar surface achieves a design with improved ball control and durability characteristics. Improved ball control is gained through an absence of seams on areas that are critical for ball control, specifically the palmar and lateral surfaces of the first and second digit and the palmar and medial surfaces of the fifth digit. Furthermore, the general absence of seams that connect separate sections of material on the palmar surface improves durability by eliminating common failure areas.

52 Claims, 7 Drawing Sheets

SOCCER GOALKEEPER'S GLOVE

BACKGROUND OF THE INVENTION

1. Field of the Invention

The invention relates to a protective glove for receiving the hand of a wearer for use in athletics. More particularly, the invention relates to a soccer goalkeeper's glove.

2. Description of Background Art

The protective gloves used by soccer goalkeepers, otherwise known as goalies, typically include a dorsal element and a palmar element, both being fashioned from a latex foam, and an element for securing the glove to the goalkeeper's wrist. Although goalkeeper gloves are similar in these respects, there are various modes of goalkeeper glove design that vary with respect to durability, flexibility, and seam placement, thereby affecting the goalkeeper's ability to control the ball when catching, handling, or throwing.

Goalkeeper glove characteristics are most affected by the pattern from which the dorsal and palmar elements are cut. Unlike traditional gloves fashioned from leather, cloth, or a knitted yarn, latex foam is the material of choice among goalkeeper glove designers because of its flexible and protective qualities. The use of latex foam, although having desirable characteristics, affects glove design by necessitating a dorsal and palmar element with multiple seams that may interfere with ball control or reduce durability.

As noted, the pattern from which the dorsal and palmar elements are cut affects glove characteristics. The majority of goalkeeper gloves employ one of three patterns for the dorsal and palmar elements: the traditional cut, the gunn cut, or the rifle cut pattern.

In a traditional cut glove 10, shown in FIGS. 1–2, a dorsal element 11 and a palmar element 12 are each fashioned from a single section of latex foam material, with only palmar element 12, shown separately in FIG. 3, having an attached thumb region. Supplemental elements (not shown), formed from a flexible material, connect dorsal and palmar elements 11 and 12 in the second through fifth digit regions, thereby creating an interior space for each digit. In addition, the union of dorsal and palmar elements 11 and 12 with the supplemental elements creates a dorsal seam 13 and a palmar seam 14 on the periphery of dorsal and palmar elements 11 and 12, respectively. The dorsal thumb region includes a separate, flexible supplemental element 15 sewn to the edge of the thumb area of palmar element 12 and to dorsal element 11. This combination of elements gives traditional cut glove 10 a relatively flat, paddle-like configuration and palmar seam 14 limits the goalkeeper's control of the ball and reduces glove durability.

A gunn cut glove 20, shown in FIGS. 4–5, includes a dorsal element 21 and a palmar element 22 that are each fashioned from a single section of latex foam material, with palmar element 22, shown separately in FIG. 6, including regions for the first, second, and fifth digits and dorsal element 21 including regions for the second through fifth digits. The second and fifth digit regions of palmar element 22 have a greater width than corresponding regions of dorsal element 21. To form the glove regions for the second and fifth digits, the wider palmar regions are flexed to meet the edges of the second and fifth digit regions of dorsal element 21 and then sewn, the flexed material defining a recess for the goalkeeper's digits. A single, separate section 23, formed of latex foam material and shown separately in FIG. 7, is used to form the third and fourth digit regions of palmar element 22. Section 23 is flexed and sewn to corresponding regions on dorsal element 21 and at the base of the third and fourth digits, the flexing again forming recesses for the goalkeeper's digits. The dorsal thumb region is formed from of a separate, flexible supplemental element 24 sewn to the edge of the thumb region of palmar element 22 and to dorsal element 21.

Unlike traditional cut glove 10, gunn cut glove 20 contains only one seam 25 joining dorsal and palmar elements 21 and 22 in the digit regions due to the lack of supplemental elements. The flexing of the second and fifth digit regions of palmar element 22 and the resulting smooth palmar surface embodies the primary advantage of the gunn cut pattern over the traditional cut pattern. The digit regions of gunn cut glove 20 are rounded and lack seams on the palmar surface that may interfere with ball control. However, the gunn cut glove is more complex and costly to manufacture. Moreover, seam 26 at the base of the third and fourth digits may be uncomfortable and lack durability.

In a rifle cut glove 30, shown in, FIGS. 8–9, a dorsal element 31 and a palmar element 32 are each formed from a single section of foam material, with palmar element 32, shown separately in FIG. 10, including only the first, second, fourth, and fifth digit regions and dorsal element 31 including the second through fifth digit regions. The second digit region of palmar element 32 has a greater width than the corresponding region of dorsal element 31. A single, separate section 33 of latex foam material, also shown in FIG. 10, forms the third digit region of palmar element 31 and is sewn to palmar element 31 at the base of the third digit region. Supplemental elements (not shown), formed from a flexible material, connect edges of the dorsal and palmar elements in the third, fourth, and fifth digit regions, thereby creating an interior space for each digit. The union of dorsal and palmar elements 31 and 32 with the supplemental elements creates seams 34 and 35 on the periphery of the dorsal and palmar elements, respectively. To form the glove regions for the second digit, the wider palmar region is flexed to meet the edges of the second digit region of dorsal element 31 and then sewn, the flexed material thereby defining a recess for the goalkeeper's second digit. The dorsal thumb region includes a separate, flexible supplemental element 36 sewn to the edge of the thumb region of palmar element 32 and to dorsal element 31.

The primary advantage of rifle cut glove 30 lies in the rounded palmar surface of the second digit. Like gunn cut glove 20, rifle cut glove 30 is more complex and costly to manufacture than traditional cut glove 10. In addition, seam 37 at the base of the third digit may cause discomfort and represent an area of low durability.

Although gloves fashioned on the traditional cut, gunn cut, and rifle cut patterns are common among goalkeeper's gloves, other variations have emerged in recent years, including the variations disclosed in U.S. Pat. No. 5,774,896 to Hochmuth, U.S. Pat. No. 5,790,985 to Hochmuth, U.S. Pat. No. 6,115,842 to Hochmuth, U.S. Pat. No. 6,125,473 to Hochmuth, and U.S. Pat. No. 5,867,830 to Chen.

Based on the above discussion, soccer goalkeepers have a variety of glove designs to choose among. However, many of the existing designs include seams that interfere with ball control or generate regions of low durability. In addition, many of the designs that attempt to reduce seams often use multiple palmar elements that increase the difficulty, and thereby cost, of manufacturing. The present invention utilizes a unique goalkeeper's glove pattern that reduces the disadvantages of the prior art by removing seams that interfere with ball control, while providing a glove with high durability and low cost.

BRIEF SUMMARY OF THE INVENTION

The present invention relates to an athletic glove for protecting and receiving a hand of a wearer. The glove includes a base portion connected to a protective portion, the protective portion having a palmar element and a dorsal element. The palmar element is formed of a first shock-absorbing material and is located to substantially cover a palmar metacarpal area of the wearer's hand and a palmar side of a first digit, a second digit, a third digit, a fourth digit, and a fifth digit of the wearer's hand. The palmar element also has at least one additional section that wraps around a medial or a lateral side of at least one of the second through fifth digits to cover at least a portion of a dorsal side of the digit wrapped by said at least one additional section. The dorsal element is located opposite the palmar element and substantially covers a dorsal metacarpal area of the wearer's hand and the dorsal side of the second digit, the third digit, the fourth digit, and the fifth digit that are not covered by the at least one additional section of the palmar element.

The areas of the glove that are critical to ball control while catching, handling, or throwing include lateral sides of the first and second digit regions of the palmar element; the palmar sides of the third and fourth digits; and the medial side of the fifth digit region of the palmar element. In order to ensure that these sides and the areas connecting these sides remain free from seams that may inhibit ball control, the palmar element of the preferred embodiment contains additional sections on the first, second, and fifth digit regions. Each additional section extends from the palmar element and wraps around to the corresponding region to connect with the dorsal element, thereby creating a smooth, seamless surface. In further embodiments, the palmar element may contain at least one digit region with two additional sections that each wrap around one of the lateral or medial sides of an individual digit so as to create a greater seamless area.

In one preferred embodiment, the additional section of each of the second and fifth digit regions of the palmar element wraps around and abuts the corresponding digit region of the dorsal element. Attached to the abutting edges and lying on the interior of the glove is a length of flexible, connecting material. The flexible, connecting material may be comprised of either a separate element or sections of the base portion referenced above. This configuration provides a flexible joint on the dorsal surface that promotes ball control by facilitating bending of each of the second and fifth digits.

Prior art gloves succeed in creating smooth surfaces in the critical areas, but do so by sacrificing durability. Seams on the palmar surface that join two or more elements experience high levels of stress while the goalkeeper attempts to catch or otherwise gain control of the ball. As such, these seams tend to represent areas of low durability. The present invention alleviates the trade off between ball control and durability through a glove design that lacks seams in portions of the palmar surface that experience high levels of stress and are critical to ball control. In addition, the absence of seams decreases the difficulty of manufacture, thereby decreasing overall cost.

Together, the placement of additional regions and the absence of seams on portions of the palmar surface provide a goalkeeper's glove with an enhanced level of ball control without sacrificing durability or creating a complex, and thereby costly, glove to manufacture.

The features and objects of the present invention will become more apparent, and the invention itself will be best understood, from the following detailed description of the preferred embodiments when read with reference to the accompanying drawings.

BRIEF DESCRIPTION OF THE DRAWINGS

FIG. 11*a* is an outline view of the dorsal side of a glove according to the present invention showing the relative location of the glove and the bones of a hand received by the glove.

FIG. 12*a* is an outline view of the palmar side of a glove according to the present invention showing the relative location of the glove and the bones of a hand received by the glove.

DETAILED DESCRIPTION OF THE INVENTION

Referring to the accompanying figures, a goalkeeper's glove in accordance with the present invention is disclosed. The figures illustrate only the glove intended for use on the right hand of a wearer. It should be understood that a left glove, such glove being the mirror image of the right, is included within the scope of the present invention. In distinguishing portions of the glove or the hand received by the glove, reference will be made to areas of the hand, including a dorsal, palmar, lateral, and medial side; the five digits; and an area corresponding to the metacarpal bones. Such references are not intended to demarcate precise areas. Rather, they are intended to delineate general areas to aid in discussion.

Figure 1:
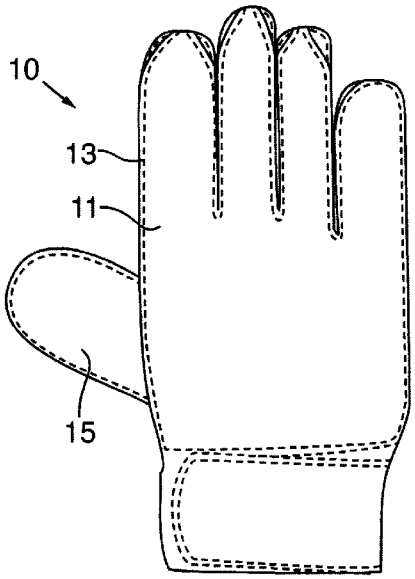
FIG. 1 (PRIOR ART)
FIG. 1 is a plan view of the dorsal side of a traditional cut glove.
Figure 2:
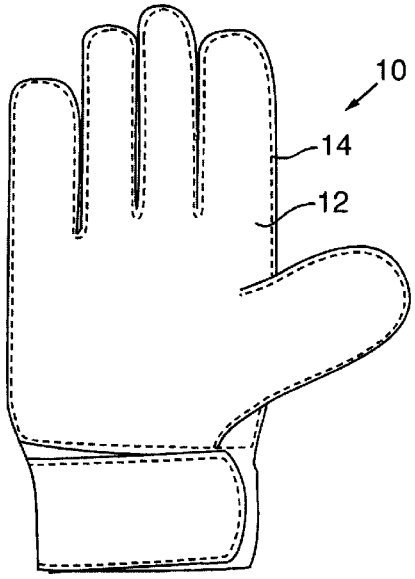
FIG. 2 (PRIOR ART)
FIG. 2 is a plan view of the palmar side of the traditional cut glove.
Figure 3:
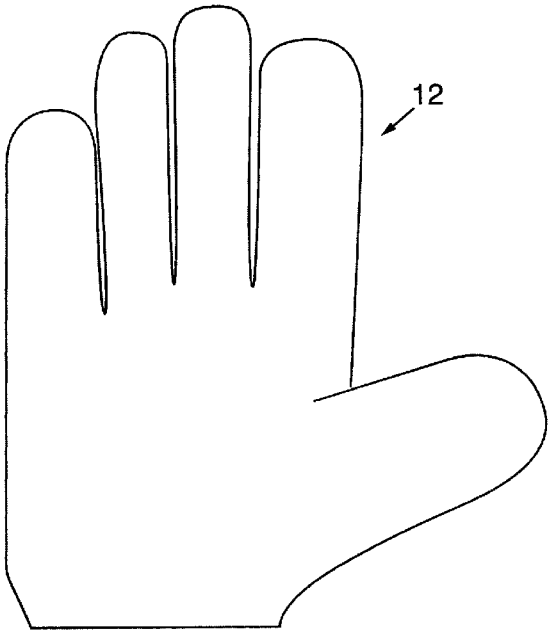
FIG. 3 (PRIOR ART)
FIG. 3 is an illustration of the pattern from which the palmar element of the traditional cut glove is formed.
Figure 4:
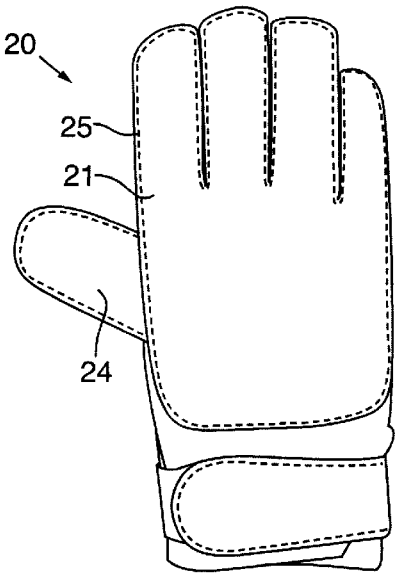
FIG. 4 (PRIOR ART)
FIG. 4 is a plan view of the dorsal side of a gunn cut glove.
Figure 5:
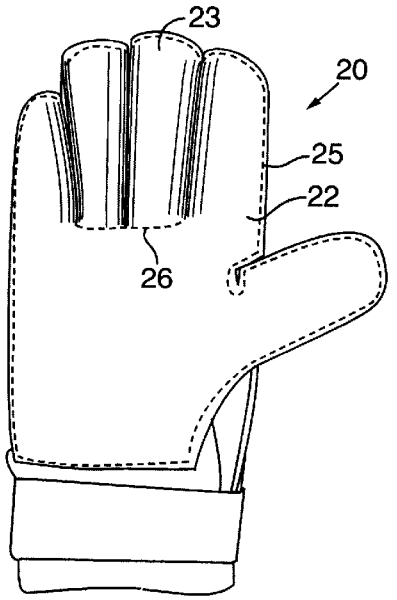
FIG. 5 (PRIOR ART)
FIG. 5 is a plan view of the palmar side of the gunn cut glove.
Figure 7:
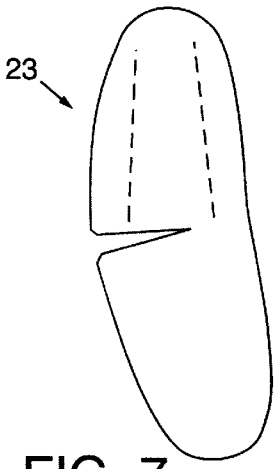
FIG. 7 (PRIOR ART)
FIG. 7 is an illustration of a second portion of the pattern from which the palmar element of the gunn cut glove is formed.
Figure 6:
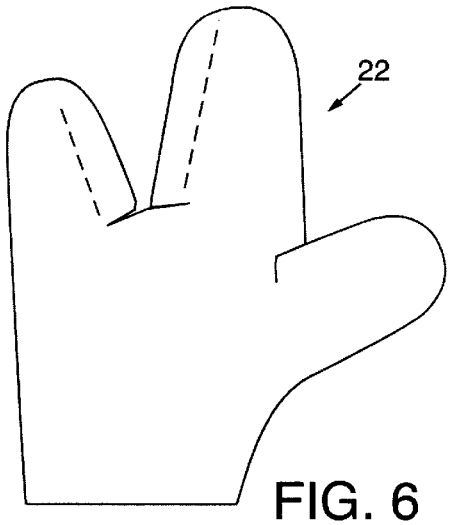
FIG. 6 (PRIOR ART)
FIG. 6 is an illustration of a first portion of the pattern from which the palmar element of the gunn cut glove is formed.
Figure 8:
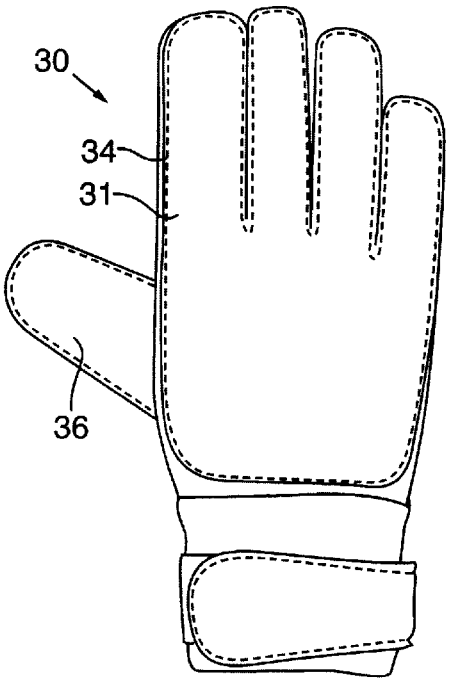
FIG. 8 (PRIOR ART)
FIG. 8 is a plan view of the dorsal side of the rifle cut glove.
Figure 9:
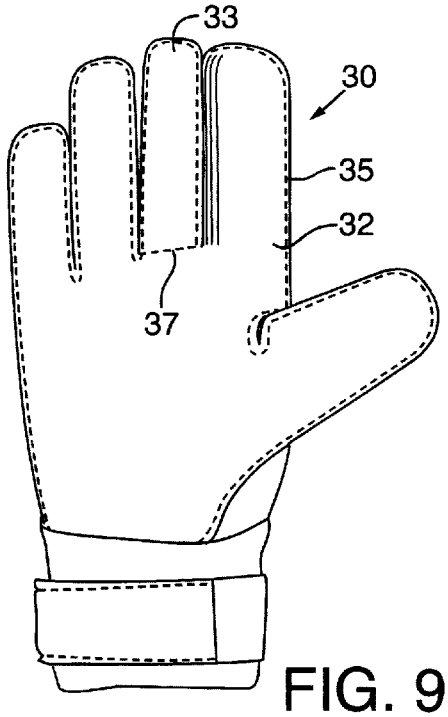
FIG. 9 (PRIOR ART)
FIG. 9 is a plan view of the palmar side of the rifle cut glove.
Figure 10:
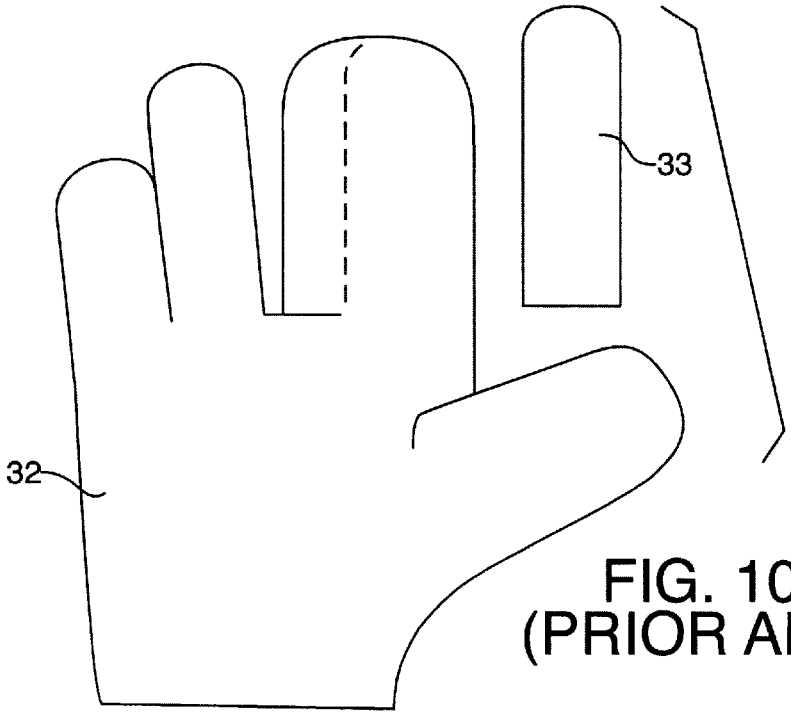
FIG. 10 (PRIOR ART)
FIG. 10 is an illustration of the patterns from which the palmar element of the rifle cut glove is formed.
Figure 11:
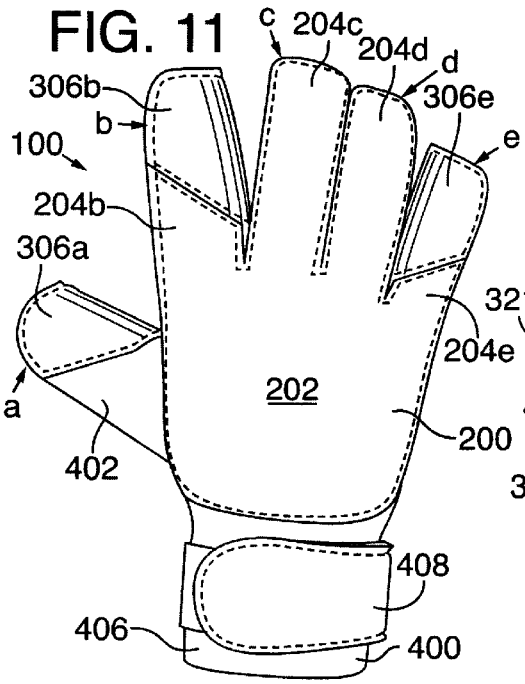
FIG. 11 is a plan view of the dorsal side of a glove according to the present invention.
Figure 12:
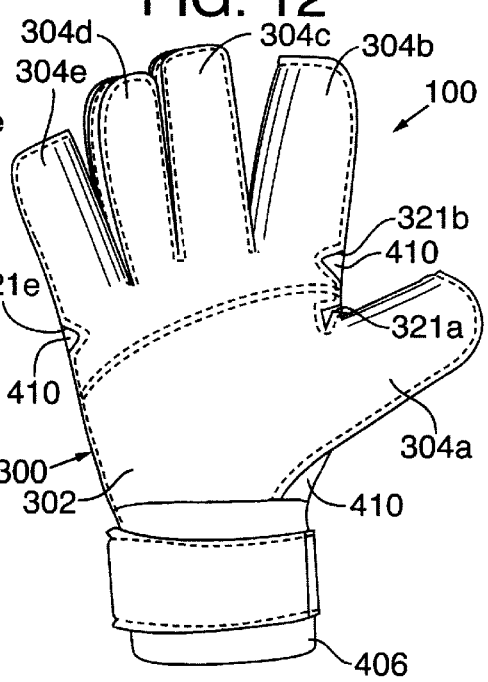
FIG. 12 is a plan view of the palmar side of a glove according to the present invention.

With reference to FIGS. 11 and 12, a goalkeeper's glove according to the present invention is illustrated, wherein the primary elements of a glove 100 include a dorsal element 200, a palmar element 300, and a plurality of elements forming a base portion 400. Dorsal element 200 and palmar element 300 may be formed of any suitable material or combination of suitable materials, including a shock-absorbing, lightweight, foamed, natural latex rubber, ranging in thickness from two to five millimeters, bonded to a lightweight scrim of poly-based cells of approximately two to three millimeters. In addition, a textile layer may be bonded to the interior surface of palmar element 300 to provide enhanced comfort. Dorsal element 200 generally covers the dorsal side of the wearer's hand, but may cover portions of the medial or lateral sides of the fingers and palm, and includes a dorsal metacarpal area 202 and dorsal digital areas 204*b*–204*e*. Dorsal metacarpal area 202 corresponds with the metacarpal bones and the joints between the metacarpals and phalanges of the second through fifth digits. Dorsal digital areas 204*b*–204*e* correspond respectively to the second through fifth digits, which are designated with letters a–e, respectively, in FIG. 11.

Figure 13:
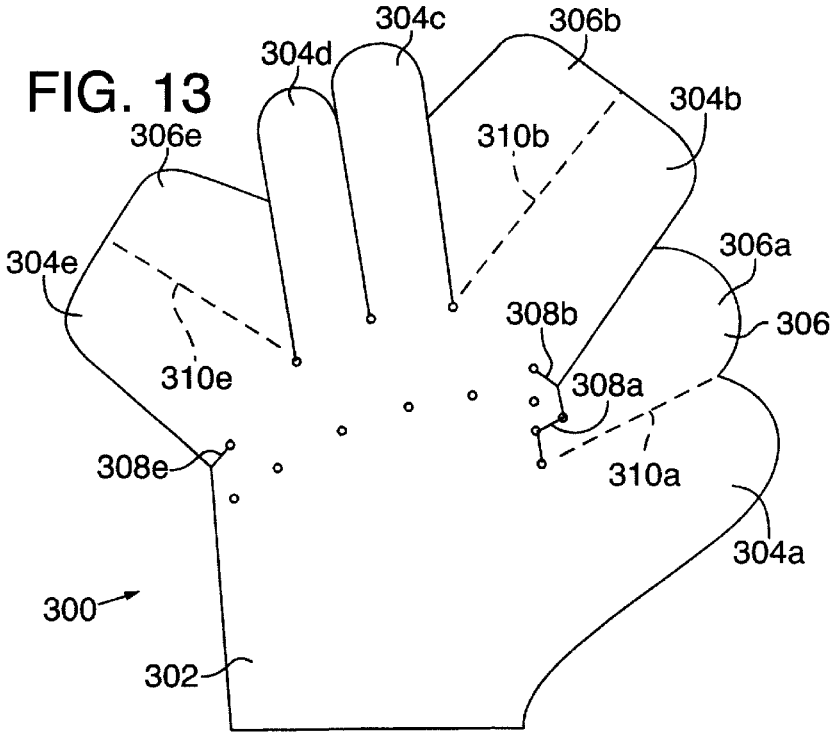
FIG. 13 is an illustration of the pattern from which the palmar element of a glove according to the present invention is formed.

The pattern of one preferred embodiment for palmar element 300 is depicted in FIG. 13. Designed to cover a substantial portion of the palmar area of the wearer's hand, palmar element 300 includes a palmar metacarpal area 302 for covering the palmar metacarpal bones and the joints between the metacarpals and phalanges of the second through fifth digits and palmar digital areas 304*a*–304*e* for covering the palmar areas of the first through fifth digits, respectively. Extending from palmar digital areas 304*a*, 304*b*, and 304*e* are additional sections 306*a*, 306*b*, and 306*e*, respectively.

The purpose of additional sections 306 are to wrap around digits, thereby creating a seamless surface that extends from the palmar area, around the sides of the digits, and to the dorsal area. A seamless surface on the medial side of the fifth digit and on lateral sides of the first and second digit create a configuration wherein the digital regions of the glove do not have seams that may interfere with ball control while catching, handling, and throwing. With respect to the first digit, additional section 306*a* wraps over line 310*a* so as to cover the lateral side of the first digit and at least a portion of the dorsal portions of the first digit. Additional section 306*a* is sewn to palmar digital area 304a and first supplemental element 402 to create a cavity for the first digit. A V-shaped cut 308*a* in palmar element 300 forms a flex notch 321*a* generally at the junction of palmar metacarpal area 302 and first palmar digital area 304*a*. In forming a cavity for receiving the second digit, additional section 306*b* wraps over line 310*b* so as to cover the lateral side of the second digit and dorsal portions of the second digit. Additional section 306*b* is sewn to palmar digital area 304*b* along the medial side and tip area, and abuts dorsal digital area 204*b* across the dorsal surface of the second digit. A straight cut 308*b* in palmar element 300 forms a flex notch 321*b* generally at the junction of palmar metacarpal area 302 and palmar digital area 304*b*. Similarly, additional section 306*e* wraps over line 310*e* so as to cover the medial side of the fifth digit and dorsal portions of the fifth digit. Additional section 306*e* is sewn to palmar digital area 304*e* along the lateral side and tip area and abuts dorsal digital area 204*e* across the dorsal surface of the fifth digit. A straight cut 308*e* in palmar element 300 forms a flex notch 321*e* generally at the junction of palmar metacarpal area 302 and palmar digital area 304*e*.

Figure 26:
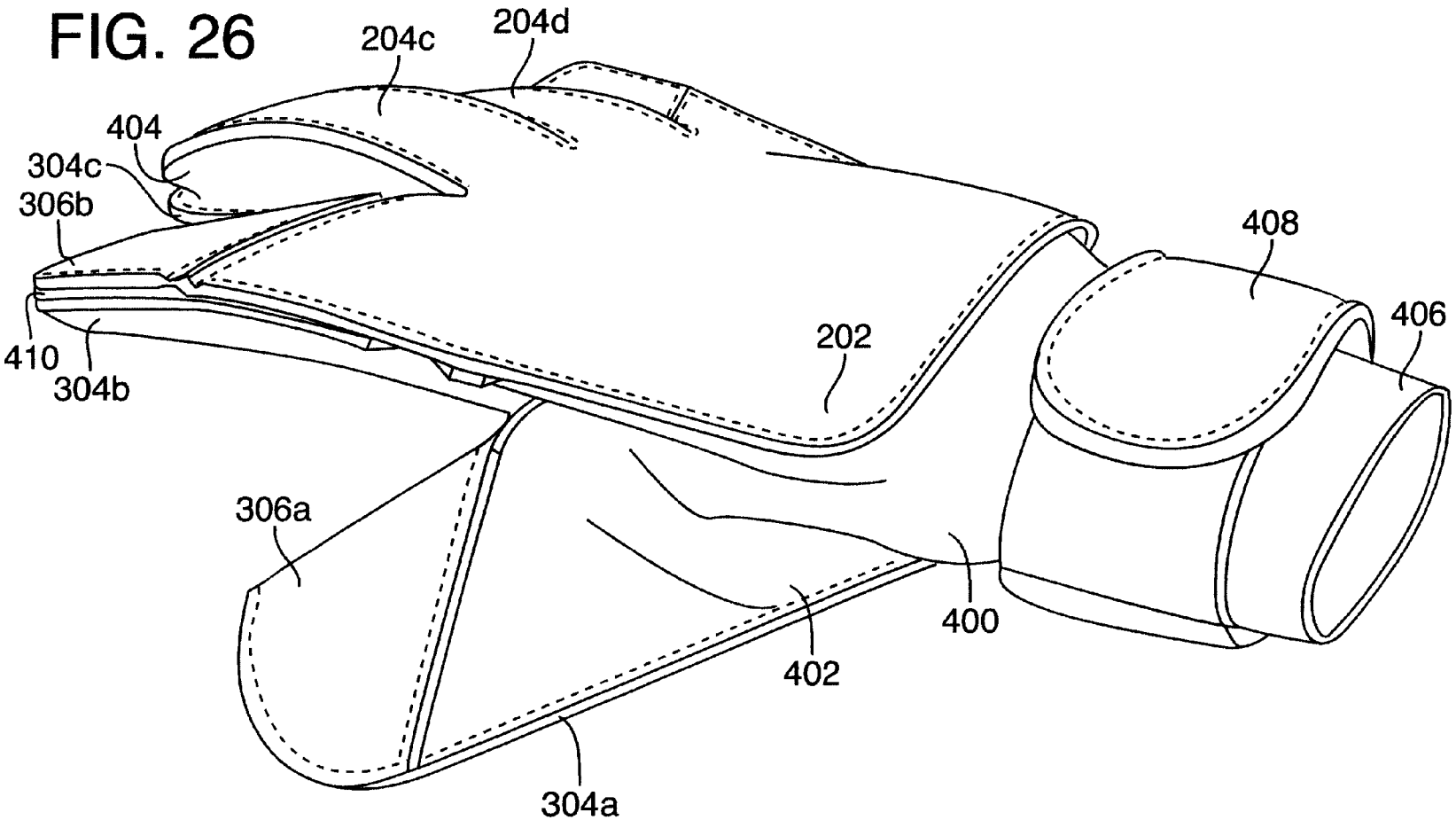
FIG. 26 is a perspective view of the top and medial side of a glove according to the present invention.

In one preferred embodiment, the union of additional section 306*b* with dorsal digital area 204*b* is accomplished by sewing additional section 306*b* and dorsal digital area 204*b* to a flexible connecting material, preferably intermediate layer 410 as shown in FIG. 26, such that the edge of additional section 306*b* abuts dorsal digital area 204*b*. This configuration forms a flexible joint in the dorsal surface. The union of additional section 306*e* with dorsal digital area 204*e* is accomplished in a similar manner and creates a second flexible joint. As noted, the seamless surface created by the wrapping of additional sections 306 around digits enhances ball control. The joints in the dorsal surface of the second and fifth digits promote this goal through increased flexibility in these digits. In a first alternative embodiment, the flexible, connecting material may include intermediate layer 410, as described below. As a second alternative embodiment, additional sections 306*b* and 306*e* could be sewn directly to dorsal digital areas 304*b* and 304*e*, respectively, and optionally, the seams could be turned inward so as to create a uniform dorsal surface.

Figure 14:
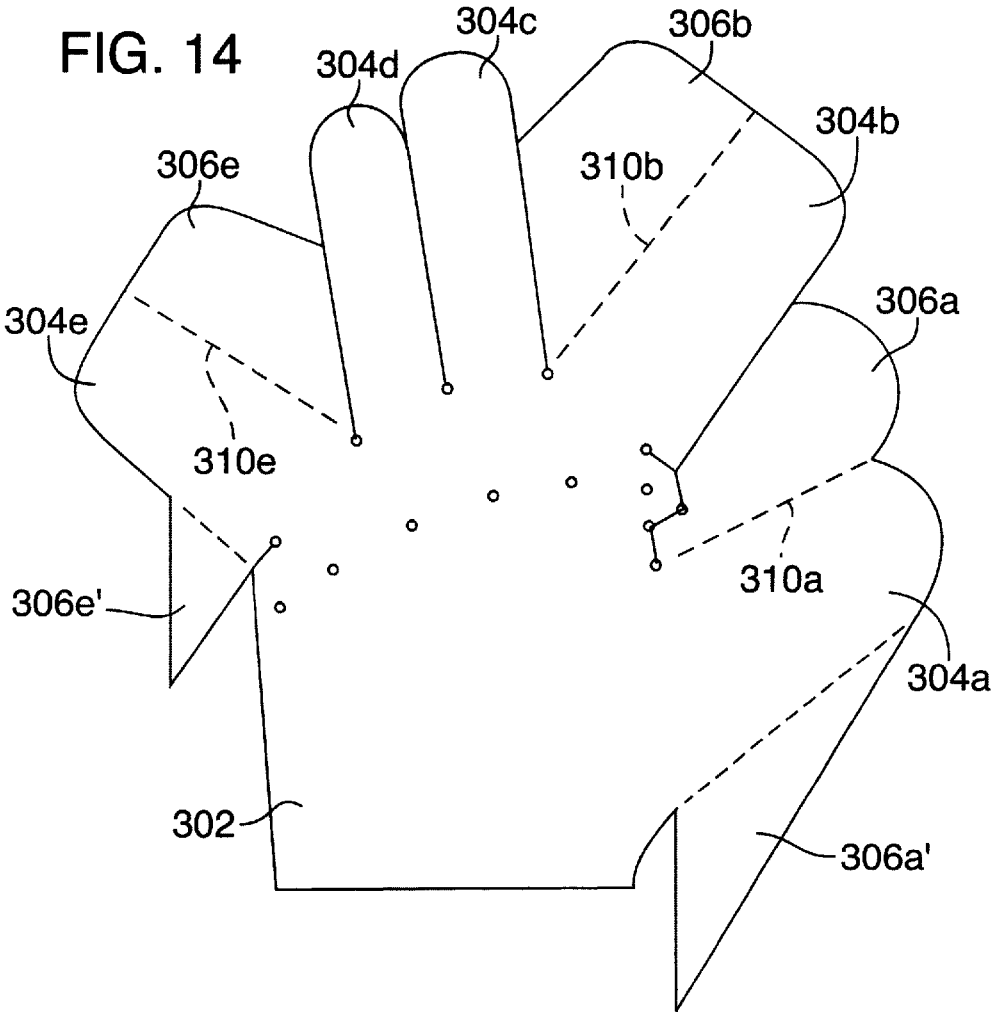
FIG. 14 is an illustration of the pattern from which the palmar element of an alternate embodiment of the glove of the present invention may be formed.
Figure 15:
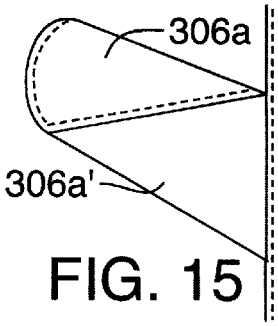
FIGS. 15–20 depict alternate configurations for the first digit area of a glove according to the present invention.
Figure 16:
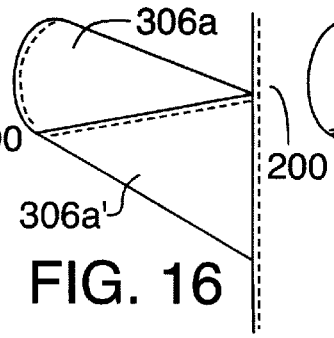
Figure 17:
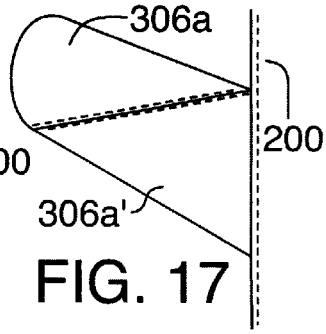
Figure 18:
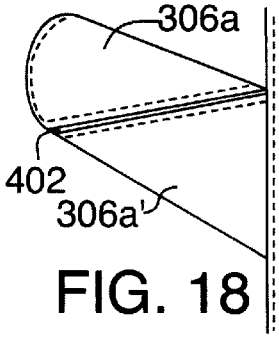
Figure 19:
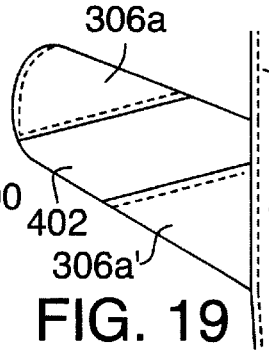

Alternative embodiments also exist with regard to the quantity of additional sections 306. As depicted in FIG. 14, palmar digital area 304*a* could include two additional sections 306, the additional sections being lateral additional section 306*a* and medial additional section 306*a*'. By altering the configuration of lateral additional section 306*a* and medial additional section 306*a*', five alternative embodiments emerge wherein medial additional section 306*a*' wraps around the medial side of the first digit and is joined with lateral additional section 306*a* on the dorsal surface. In the first alternate embodiment, as illustrated in FIG. 15, lateral additional section 306*a* overlaps, and is joined with, medial additional section 306*a*' on the dorsal side of the first digit. In the second alternative embodiment, as illustrated in FIG. 16, medial additional section 306*a*' overlaps lateral additional section 306*a*. In the third alternate embodiment, as illustrated in FIG. 17, lateral additional section 306*a* and medial additional section 306*a*' are directly joined and the ridge produced by the seam is inverted so as to be hidden from view. In the fourth alternate embodiment, as illustrated in FIG. 18, lateral additional section 306*a* and medial additional section 306*a*' abut on the dorsal side of the first digit and are connected using a flexible, connecting material on the interior of glove 100. As with the primary embodiment of the second and fifth digits, this arrangement provides a configuration wherein the dorsal side of the first digit includes a joint that facilitates bending. In the fifth alternative embodiment, as illustrated in FIG. 19, lateral additional section 306*a* and medial additional section 306*a*' are connected to opposite sides of a flexible, connecting material. Unlike the fourth alternate embodiment, the edges of lateral additional section 306*a* and medial additional section 306*a*' do not abut. Instead, a gap with the flexible, connecting material disposed therein separates the edges. With reference to both the fourth and fifth alternative embodiments, as described in this paragraph, the flexible, connecting material may be formed of first supplemental element 402. Alternatively, the flexible, connecting material may be intermediate layer 410, as described below.

Figure 21:
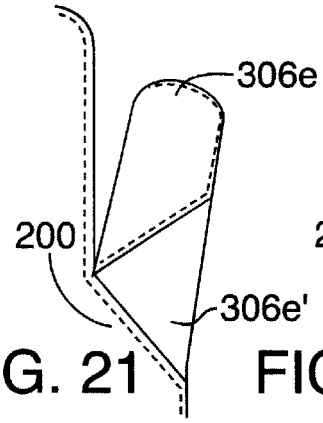
FIGS. 21–25 depict alternate configurations for the fifth digit area of a glove according to the present invention.
Figure 22:
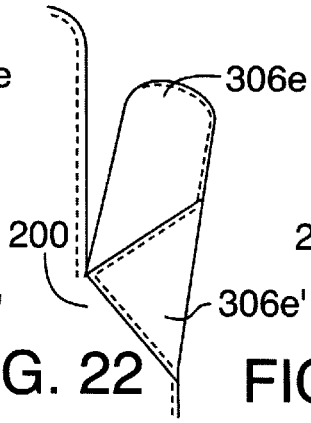
Figure 23:
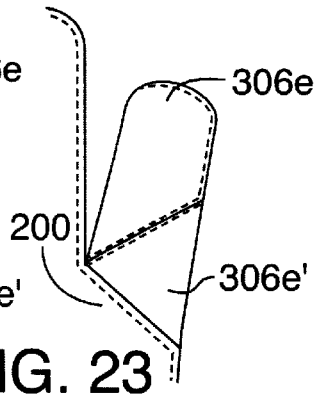
Figure 24:
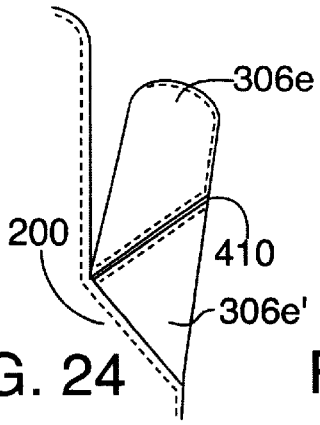
Figure 25:
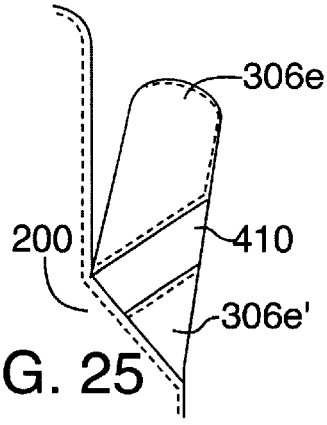

The possibility of using two or more additional sections to wrap an individual digit is not limited to the first digit. As depicted in FIG. 14, palmar digital area 304*e* could include medial additional section 306*e* and lateral additional section 306*e*' which provide alternate embodiments similar to that depicted in FIGS. 15–19. A configuration wherein medial additional element 306*e* overlaps lateral additional element 306*e*' is depicted in FIG. 21. The opposite configuration, wherein lateral additional element 306*e*' overlaps medial additional element 306*e* is illustrated in FIG. 22. With reference to FIG. 23, additional sections 306*e* and 306*e*' are directly joined and the ridge produced by the seam is inverted so as to be hidden from view. Medial additional element 306*e* and lateral additional element 306*e*' abut on the dorsal surface of the fifth digit and are joined to opposite sides of a flexible, connecting material, as depicted in FIG. 24, so as to form a flexible joint. FIG. 25 depicts a similar configuration wherein a gap having the flexible, connecting material disposed therein separates medial additional element 306*e* and lateral additional element 306*e*'. The flexible, connecting material referenced above may be formed of intermediate layer 410, as described below.

Base portion 400 covers areas of the hand not covered by dorsal element 200 or palmar element 300. In addition, base portion 400 may serve to connect portions of dorsal element 200 with palmar element 300. As shown in FIG. 26, specific sections of base portion 400 may include first supplemental element 402; longitudinal supplemental elements 404; wrist element 406; strap 408; and intermediate layer 410.

Figure 20:
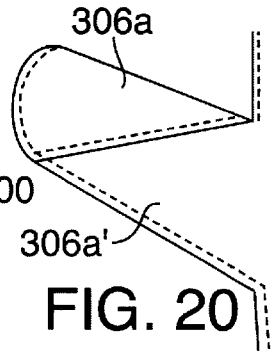

First supplemental element 402 covers portions of the dorsal area of the first digit that are not covered by additional section 306*a* and is attached to the medial edge of palmar digital area 304*a*, additional section 306*a*, and dorsal metacarpal area 202. Although first supplemental element 402 is preferably formed of synthetic leather, other durable materials may be used. To abrogate the need for first supplemental element 402, an alternate embodiment exists wherein a projection of dorsal element 200, as depicted in FIG. 20, extends over the dorsal surface of the first digit and is joined with additional section 306*a*.

Longitudinal supplemental elements 404, as shown in FIG. 26, connect dorsal digital areas 204*c* and 204*d* with palmar digital areas 304*c* and 304*d*, respectively, thereby creating a cavity for reception of the third and fourth digits. Following attachment of longitudinal supplemental elements 404, the tip area of dorsal digital areas 204*c* and 204*d* may be sewn to palmar digital areas 304*c* and 304*d*, respectively.

Wrist element 406, which can be formed of an elastic material, connects dorsal metacarpal area 202 with palmar metacarpal area 302 in the area of the carpal bones and secures glove 100 to the hand. Strap 408 is attached to elastic wrist element 406 on the medial side. Through the action of hook and loop fasteners, strap 408 surrounds and releasably attaches to a substantial portion of the circumference of elastic wrist element 406.

Intermediate layer 410 lies beneath dorsal element 200 and additional sections 306*b* and 306*e* and may be used as the flexible, connecting material to which the edges of dorsal digital areas 204*b* and 204*e* and additional sections 306*b* and 306*e* are sewn.

Supplemental element 402, longitudinal supplemental elements 404, and intermediate layer 410 are preferably formed of three separate elements. However, in alternate embodiments, a single element may be used for intermediate layer 410 and elements 402 and 404.

This invention has been disclosed with reference to the preferred embodiments. These embodiments, however, are merely for example only and the invention is not restricted thereto. It will be understood by those skilled in the art that other variations and modifications can easily be made within the scope of this invention as defined by the appended claims.

That which is claimed is:

1. An athletic glove for protecting and receiving a hand of a wearer, said glove comprising a base portion connected to a protective portion, said protective portion having a palmar element and a dorsal element:

said palmar element being formed of a first shock-absorbing material and being located to substantially cover:

a palmar metacarpal area of the hand, and a palmar side of a first digit, a second digit, a third digit, a fourth digit, and a fifth digit of the hand, and having an additional second digit section that wraps around the second digit to cover at least a portion of a dorsal side of the second digit and an additional fifth digit section that wraps around the fifth digit to cover at least a portion of a dorsal side of the fifth digit, said additional second digit section and said additional fifth digit section providing a configuration wherein a portion of the palmar side and a lateral side of the second digit and a portion of the palmar side and a medial side of the fifth digit are covered by portions of said palmar element having a seamless surface; and said dorsal element being located opposite said palmar element and substantially covering:

a dorsal metacarpal area of the hand, and a dorsal side of the third digit and the fourth digit.

2. The athletic glove of claim 1, wherein said dorsal element includes a second shock-absorbing material.

3. The athletic glove of claim 2, wherein said palmar element is formed from a single section of said first shock-absorbing material.

4. The athletic glove of claim 3, wherein said first shock-absorbing material is a foamed, natural latex rubber.

5. The athletic glove of claim 4, wherein said second shock-absorbing material is the same as said first shock-absorbing material.

6. The athletic glove of claim 1, wherein said additional second digit section abuts said dorsal element on the dorsal side of the second digit, and said additional fifth digit section abuts said dorsal element on the dorsal side of the fifth digit.

7. The athletic glove of claim 1, wherein the first digit area of said palmar element includes at least one additional first digit section that wraps around the first digit to cover at least a portion of the dorsal side of the first digit.

8. The athletic glove of claim 7, wherein said dorsal element extends over the dorsal side of the first digit and is joined with said at least one additional first digit section.

9. The athletic glove of claim 1, wherein a region of said palmar element corresponding to an individual digit is comprised of at least two additional digital sections, said additional digital sections being located on opposite sides of said region of said palmar element corresponding to an individual digit.

10. The athletic glove of claim 8, wherein said at least two additional sections wrap around opposite sides of a digit of the wearer so as to cover substantially all of the dorsal side of said digit.

11. An athletic glove for protecting and receiving a hand of a wearer, said glove comprising a base portion connected to a protective portion, said protective portion having a palmar element and a dorsal element, said palmar element being formed from a single section of a first shock-absorbing material and being located to substantially cover:

a palmar metacarpal area of the hand; and a palmar side of a first digit, a second digit, a third digit, a fourth digit, and a fifth digit of the hand, and having at least one additional section that wraps around one of a medial and a lateral side of at least one of the second through fifth digits to cover at least a portion of a dorsal side of the at least one of the second through fifth digits wrapped by said at least one additional section, said dorsal element being formed from a second shock-absorbing material and located opposite said palmar element.

12. The athletic glove of claim 11, wherein said dorsal element is formed from a single section of said second shock-absorbing material.

13. The athletic glove of claim 11, wherein said first shock-absorbing material is a foamed, natural latex rubber.

14. The athletic glove of claim 11, wherein said second shock-absorbing material is the same as said first shock-absorbing material.

15. An athletic glove for protecting and receiving a hand of a wearer, said glove comprising a base portion connected to a protective portion, said protective portion having a palmar element and a dorsal element located opposite said palmar element, said palmar element being formed of a first shock-absorbing material and being located to substantially cover:

a palmar metacarpal area of the hand; and a palmar side of a first digit, a second digit, a third digit, a fourth digit, and a fifth digit of the hand, and having at least one additional section that wraps around one of a medial and a lateral side of at least one of the second through fifth digits to cover at least a portion of a dorsal side of the at least one of the second through fifth digits wrapped by said at least one additional section, said at least one additional section of said palmar element including an additional second digit section that wraps around the second digit of the wearer, and an additional fifth digit section that wraps around the fifth digit of the wearer, said additional second digit section covering a portion of the dorsal side of the second digit and said additional fifth digit section covering a portion of the dorsal side of the fifth digit.

16. The athletic glove of claim 15, wherein said additional second digit section abuts said dorsal element on the dorsal side of the second digit, and said additional fifth digit section abuts said dorsal element on a dorsal side of the fifth digit.

17. An athletic glove for protecting and receiving a hand of a wearer, said glove comprising a base portion connected to a protective portion, said protective portion having a palmar element and a dorsal element located opposite said palmar element, said palmar element being formed of a first shock-absorbing material and being located to substantially cover:

a palmar metacarpal area of the hand;

a palmar side of a first digit to define a first digit area that includes at least one additional first digit section that wraps around the first digit to cover at least a portion of a dorsal side of the first digit; and a palmar side of a second digit, a third digit, a fourth digit, and a fifth digit of the hand, said palmar element having at least one additional section that wraps around one of a medial and a lateral side of at least one of the second through fifth digits to cover at least a portion of a dorsal side of the at least one of the second through fifth digits wrapped by said at least one additional section.

18. The athletic glove of claim 17, wherein said dorsal element extends over the dorsal side of the first digit and is joined with said at least one additional first digit section.

19. The athletic glove of claim 17, wherein said at least one additional first digit section includes a medial section and a lateral section, said medial section extending from a medial side of said first digit area of said palmar element and said lateral section extending from a lateral side of said first digit area of said palmar element, said medial and lateral sections wrapping around the first digit to cover substantially all of the dorsal side of the first digit.

20. The athletic glove of claim 19, wherein said medial section and said lateral section are joined on the dorsal side of the first digit where said lateral section overlaps an edge of said medial section.

21. The athletic glove of claim 19, wherein said medial section and said lateral section are joined on the dorsal side of the first digit where said medial section overlaps an edge of said lateral section.

22. The athletic glove of claim 19, wherein said medial section and said lateral section are joined to form a seam, said seam being on the interior of said glove.

23. The athletic glove of claim 19, wherein said medial section and said lateral section abut on the dorsal side of the first digit.

24. The athletic glove of claim 19, wherein said medial section and said lateral section are joined to a flexible, connecting material to form a flexible joint on the dorsal side of the first digit.

25. An athletic glove for protecting and receiving a hand of a wearer, said glove comprising a base portion connected to a protective portion, said protective portion having a palmar element and a dorsal element located opposite said palmar element, said palmar element being formed of a first shock-absorbing material and being located to substantially cover:

a palmar metacarpal area of the hand; and a palmar side of a first digit, a second digit, a third digit, a fourth digit, and a fifth digit of the hand, and having at least one additional section that wraps around one of a medial and a lateral side of at least one of the second through fifth digits to cover at least a portion of a dorsal side of the at least one of the second through fifth digits wrapped by said at least one additional section, wherein a fifth digit area of said palmar element includes said at least one additional section, said at least one additional section including a medial section and a lateral section, said medial section extending from a medial side of said fifth digit area of said palmar element and said lateral section extending from a lateral side of said fifth digit area of said palmar element, said medial section and said lateral section wrapping around the fifth digit to cover substantially all of the dorsal side of the fifth digit.

26. The athletic glove of claim 25, wherein said medial section and said lateral section are joined on the dorsal side of the fifth digit and said lateral section overlaps an edge of said medial section.

27. The athletic glove of claim 25, wherein said medial section and said lateral section are joined on the dorsal side of the fifth digit where said medial section overlaps an edge of said lateral section.

28. The athletic glove of claim 25, wherein said medial section and said lateral section are joined to form a seam, said seam positioned on the interior of said glove.

29. The athletic glove of claim 25, wherein said medial section and said lateral section abut on the dorsal side of the fifth digit.

30. The athletic glove of claim 25, wherein said medial section and said lateral section are joined to a flexible, connecting material to form a flexible joint on the dorsal side of the first digit.

31. An athletic glove for protecting and receiving a hand of a wearer, said glove comprising a base portion connected to a protective portion, said protective portion having a palmar element and a dorsal element located, opposite said palmar element, said palmar element being formed of a first shock-absorbing material and being located to substantially cover:

a palmar metacarpal area of the hand; and a palmar side of a first digit, a second digit, a third digit, a fourth digit, and a fifth digit of the hand, and having at least one additional section that wraps around one of a medial and a lateral side of at least one of the second through fifth digits to cover at least a portion of a dorsal side of the at least one of the second through fifth digits wrapped by said at least one additional section, wherein the external edge of said palmar element includes a first notch located at the intersection of the first digit and the palm, a second notch located at the intersection of the second digit and the palm, and a third notch located at the intersection of the fifth digit and the palm.

32. An athletic glove for receiving a hand of a wearer, said glove comprising a palmar element and an opposite dorsal element, said palmar element being a single section of shock-absorbing material that defines a palmar metacarpal area formed integral with a plurality of palmar digital areas, said palmar digital areas being configured to cover a palmar side of a first digit, a second digit, a third digit, a fourth digit, and a fifth digit, one of said palmar digital areas having an additional section that wraps around one of a medial and a lateral side of one of the second through fifth digits to cover at least a portion of a dorsal side of the one of the second through fifth digits.

33. The athletic glove of claim 32, wherein said dorsal element includes a dorsal metacarpal area formed integral with a plurality of dorsal digital areas.

34. The athletic clove of claim 33, wherein one of said dorsal digital areas is joined with said additional section.

35. The athletic glove of claim 32, further including a base portion, said palmar element and said dorsal element being attached to said base portion.

36. The athletic glove of claim 32, wherein said palmar digital areas include a first digit area having at least one additional first digit section that wraps around the first digit to cover at least a portion of a dorsal side of the first digit.

37. The athletic glove of claim 32, wherein said at least one additional section includes a medial section and a lateral section, said medial section extending from a medial side of the one of the second through fifth digits and said lateral section extending from a lateral side of the one of the second through fifth digits, said medial and lateral sections wrapping around the one of the second through fifth digits to cover substantially all of the dorsal side of the one of the second through fifth digits.

38. An athletic glove for receiving a hand of a wearer, said athletic glove comprising a palmar element and a separate dorsal element located opposite said palmar element, said palmar element being a single section of a shock-absorbing material that defines a palmar metacarpal area formed integral with a plurality of palmar digital areas, said palmar digital areas being configured to cover a palmar side of a first digit, a second digit, a third digit, a fourth digit, and a fifth digit, a second of said palmar digital areas having a single additional second digit section that wraps around a lateral side of the second digit to cover at least a portion of a dorsal side of the second digit.

39. The athletic glove of claim 38, wherein said dorsal element includes a dorsal metacarpal area formed integral with a plurality of dorsal digital areas.

40. The athletic clove of claim 39, wherein one of said dorsal digital areas abuts said additional second digit section.

41. The athletic glove of claim 38, wherein a first of said palmar digital areas includes an additional first digit section that wraps around a lateral side of the first digit to cover at least a portion of a dorsal side of the first digit.

42. The athletic glove of claim 38, further including a base portion, said palmar element and said dorsal element being attached to said base portion.

43. An athletic glove for receiving a hand of a wearer, said athletic glove comprising a palmar element and an opposite dorsal element, said palmar element being a single section of shock-absorbing material that defines a palmar metacarpal area formed integral with a plurality of palmar digital areas, said palmar digital areas being configured to cover a palmar side of a first digit, a second digit, a third digit, a fourth digit, and a fifth digit, a second of said palmar digital areas having an additional second digit section that wraps around one of a medial and a lateral side of the second digit to cover at least a portion of a dorsal side of the second digit, and a fifth of said palmar digital areas having an additional fifth digit section that wraps around one of a medial and a lateral side of the fifth digit to cover at least a portion of a dorsal side of the fifth digit.

44. The athletic glove of claim 43, wherein said dorsal element includes a dorsal metacarpal area formed integral with a plurality of dorsal digital areas.

45. The athletic clove of claim 44, wherein a second of said dorsal digital areas is joined with said additional second digit section, and a fifth of said dorsal digital areas is joined with said additional fifth digit section.

46. The athletic glove of claim 43, wherein a first of said palmar digital areas includes an additional first digit section that wraps around a lateral side of the first digit to cover at least a portion of a dorsal side of the first digit.

47. An athletic glove for receiving a hand of a wearer, said athletic glove comprising a palmar element and an opposite dorsal element, said palmar element defining a plurality of palmar digital areas configured to cover a palmar side of at least a first digit, a second digit, and a fifth digit of the hand, a first of said palmar digital areas having a first additional section that wraps around one of a medial and a lateral side of the first digit to cover at least a portion of a dorsal side of the first digit, a second of said palmar digital areas having a second additional section that wraps around one of a medial and a lateral side of the second digit to cover at least a portion of a dorsal side of the second digit, and a fifth of said palmar digital areas having a-fifth additional section that wraps around one of a medial and a lateral side of the fifth digit to cover at least a portion of a dorsal side of the fifth digit.

48. The athletic glove of claim 47, wherein said dorsal element includes a dorsal metacarpal area formed integral with a plurality of dorsal digital areas.

49. The athletic glove of claim 48, wherein a second of said dorsal digital areas is joined with said second additional section, and a fifth of said dorsal digital areas is joined with said fifth additional section.

50. The athletic glove of claim 47, wherein a third of said dorsal digital areas covers a substantial portion of a dorsal side of a third digit of the hand, and a fourth of said dorsal digital areas covers a substantial portion of a dorsal side of a fourth digit of the hand.

51. The athletic glove of claim 47, further including a base portion, said palmar element and said dorsal element being attached to said base portion.

52. The athletic glove of claim 47, wherein said material is a shock-absorbing material.

* * * * *